United States Patent [19]

Iwase

[11] Patent Number: 4,864,947

[45] Date of Patent: Sep. 12, 1989

[54] SEWING MACHINE

[75] Inventor: Hideo Iwase, Tokyo, Japan

[73] Assignees: Iwase Prince Kabushiki Kaisha; Prince Mishin Kabushiki Kaisha, both of Tokyo, Japan

[21] Appl. No.: 184,492

[22] PCT Filed: Jun. 15, 1987

[86] PCT No.: PCT/JP87/00388

§ 371 Date: Feb. 12, 1988

§ 102(e) Date: Feb. 12, 1988

[87] PCT Pub. No.: WO87/07659

PCT Pub. Date: Dec. 17, 1987

[30] Foreign Application Priority Data

Jun. 14, 1986 [JP] Japan ..... 61-138712

[51] Int. Cl.[4] ..... D05B 3/00

[52] U.S. Cl. ..... 112/121.14; 112/220; 112/121.12

[58] Field of Search ..... 112/121.14, 121.12, 112/121.15, 98, 102, 221, 220

[56] References Cited

U.S. PATENT DOCUMENTS

| | | | |
|---|---|---|---|
| 3,515,080 | 6/1970 | Ramsey | 112/121.12 X |
| 3,765,349 | 10/1973 | Gerber | 112/121.14 |
| 4,512,269 | 4/1985 | Bowditch | 112/121.14 X |
| 4,557,206 | 12/1985 | Iwase . | |
| 4,674,421 | 6/1987 | Iwase . | |

FOREIGN PATENT DOCUMENTS

| | | |
|---|---|---|
| 0107910 | 9/1984 | European Pat. Off. . |
| 47-17571 | 5/1972 | Japan . |
| 56-8638 | 2/1981 | Japan . |
| 58-02966 | 9/1983 | Japan . |
| 59-174167 | 11/1984 | Japan . |
| 60-142887 | 7/1985 | Japan . |
| 60-45550 | 10/1985 | Japan . |
| 61-48395 | 3/1986 | Japan . |

*Primary Examiner*—H. Hampton Hunter

*Attorney, Agent, or Firm*—Cushman, Darby & Cushman

[57] ABSTRACT

There is disclosed a sewing machine suitable for sewing articles such as clothes, bedclothes and the like, and, in particular, for thick bed quilts or futon comforters. This sewing machine includes: a machine frame (10); upper and lower support bases (27), (33) connected to the machine frame for horizontal movement; upper and lower rotary members (26), (32) connected respectively to the upper and lower support bases for turning movement; a machine body (55) having an arm unit (56) and a bed unit (57), the arm unit being connected to the upper rotary member, the bed unit confronting the arm unit and being secured to the lower rotary member; a mounting mechanism (58) interconnecting the arm unit with the upper rotary member for upward and downward movement of the arm unit; and a vertical drive mechanism (59) for moving the arm unit upward and downward. The upper and lower support bases are adapted to be driven synchronously with each other along their respective guide members by an X-axis drive mechanism. The upper and lower rotary members are adapted to be turned synchronously with each other by a turning mechanism. The arm unit has a needle bar, while the bed unit has a rotating hook. The needle bar of the arm unit and the rotating hook are adapted to be driven synchronously with each other by a machine body drive mechanism.

8 Claims, 6 Drawing Sheets

SEWING MACHINE

TECHNICAL FIELD

This invention relates to a nonstandard sewing machine for industrial use, which is suitable for sewing clothes, bedclothes and the like, and, in particular, for thick bed quilts or futon comforters.

BACKGROUND ART

The applicant of this invention previously developed a nonstandard sewing machine for sewing thick quilts, which is disclosed in Japanese Patent Publication No. sho 56-8638. This sewing machine includes, a machine frame provided with upper and lower horizontal guide rails, an arm unit with a needle bar and a bed unit with a rotating hook. The arm and bed units confront each other and are connected respectively to the upper and lower guide rails for movement along the respective upper and lower guide rails. This sewing machine has an advantage in that it requires only about a quarter to a half of the floor space that is required by a conventional sewing machine including a horizontally movable quilt-supporting bed and an stable machine body with an arm and bed unit.

However, in the above-described sewing machine, since the distance between the arm unit and the bed unit is not adjustable, there arises a problem that it is not easy to efficiently perform the setting and withdrawing of a quilt into and from the proper position between the arm and bed units.

Accordingly, it is an object of the present invention to provide a sewing machine which can be installed in a rather narrow floor space.

Another object of the present invention is to provide a sewing machine in which the setting and the withdrawing of an article to be sewn are easily performed upon the beginning and the ending of the sewing operation.

DISCLOSURE OF THE INVENTION

With the aforementioned objects in view, the present invention provides a sewing machine comprising: a machine frame; upper and lower support bases connected to the machine frame; upper and lower rotary members connected respectively to the upper and lower support bases for rotational movement about vertical axes; a machine body including an arm unit and a separate bed unit, the arm unit being connected to the upper rotary member, the bed unit confronting the arm unit and being secured to the lower rotary member; mounting means interconnecting the arm unit with the upper rotary member for upward and downward movement of the arm unit with respect to the upper rotary member; and vertical drive means for driving the arm unit upward and downward. The machine frame has upper and lower spaced parallel X-axis guide members extending horizontally. The upper and lower support bases are connected respectively to the upper and lower X-axis guide members for movement along the respective upper and lower guide members. The upper and lower support bases are adapted to be driven synchronously with each other along the respective upper and lower X-axis guide members by support bases drive means. The upper and lower rotary members are adapted to be turned synchronously with each other by turning means. The arm unit has a needle bar, while the bed unit has a rotating hook. The needle bar of the arm unit and the rotating hook of the bed unit are adapted to be operated synchronously with each other by machine body drive means. The sewing machine with the aforementioned construction does not occupy a inconveniently wide floor space, and enhances efficiency of the setting and withdrawing of quilts since, due to the movable arm unit, the distance between the arm unit and the bed unit is adjustable.

It is preferred that the upper rotary member is of a vertical tubular construction with a flange portion formed therearound. It is also preferred that the mounting means comprises a support rod having upper and lower end portions, the upper end portion slidably passing through the flange portion of the upper rotary member for upward and downward movement, the lower end portion being fixed to the arm unit.

The vertical drive means may be a cylinder actuator interposed between the upper rotary member and the arm unit.

The machine body drive means may include: a transmitting shaft inserted into the upper rotary member for rotational movement about an axis thereof; a machine actuator for rotating the transmitting shaft; and a sliding pulley for transmitting the torque of the transmitting shaft to the driven shaft of the needle bar. In this case, the arm unit has a pulley holder, and the sliding pulley is splined to the transmitting shaft. Furthermore, the sliding pulley is connected to the pulley holder for rotation about its axis. In this construction, the sliding pulley moves upward and downward together with the arm unit.

The sewing machine according to the present invention, may includes a wire conduit axially passing through the transmitting shaft for rotation about an axis thereof, and twist-preventing means for turning the wire conduit at the same angle and in the same direction as the upper rotary member. When lead wires and the like are disposed in the wire conduit, the twist-preventing means prevents the wire from twisting. Furthermore, this sewing machine may include, a horizontal Y-axis guide member extending perpendicularly to the X-axis guide members, and machine frame drive means for driving the machine frame along the Y-axis guide member.

It is preferred that the X-axis drive means includes: upper and lower travelling nuts secured to the upper and lower support bases respectively; upper and lower lead screws threadedly engaged respectively with the upper and lower traveling nuts and extending respectively along the upper and lower X-axis guide members, the upper and lower lead screws being connected to the machine frame for rotation about their axes; lead screws-interlocking means for connecting the upper and lower lead screws so that the lead screws are rotated synchronously with each other; and a support bases-driving actuator drivingly connected to either of the upper and lower lead screws.

It is also preferred that the turning means includes: upper and lower worm gears coaxially secured to the upper and lower rotary members respectively; upper and lower worms meshed respectively with the upper and lower worm gears; upper and lower spline shafts splined respectively to the upper and lower worms and extending along the respective upper and lower guide members, the upper and lower spline shafts connected to the machine frame for rotational movement about their respective axes; spline shafts-interlocking means for connecting the upper and lower spline shafts so that the spline shafts are turned synchronously with each other; and a rotary members-driving actuator for turning both the spline shafts under the control of the spline shafts-interlocking means.

BRIEF DESCRIPTION OF THE DRAWINGS

In the drawings:

FIG. 5 is an enlarged axial cross-sectional view of an upper support base, an upper rotary member, an upper transmitting shaft and the like;

BEST MODE FOR CARRYING OUT THE INVENTION

Figure 1:
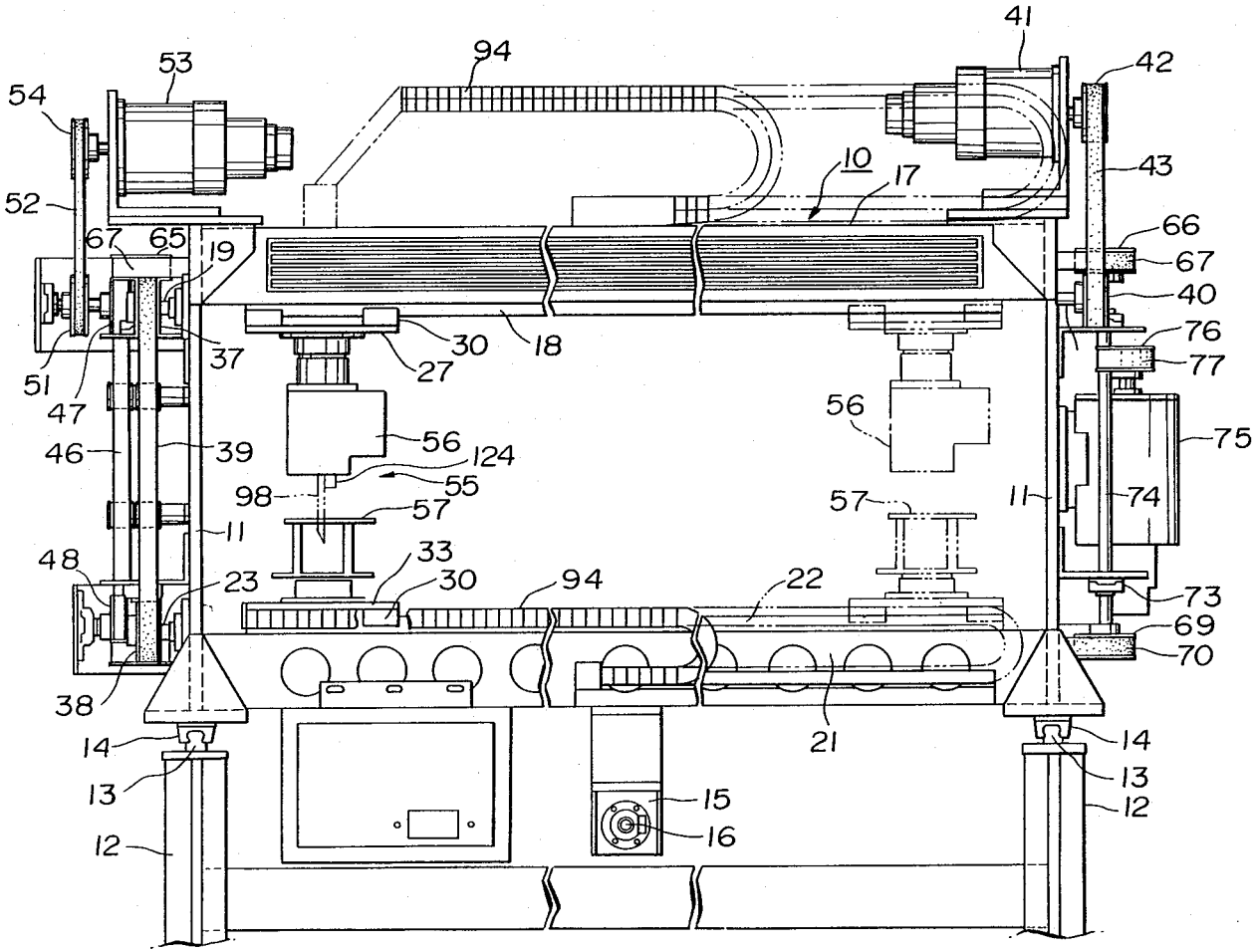
FIG. 1 is a front view of a sewing machine according to the present invention.
Figure 2:
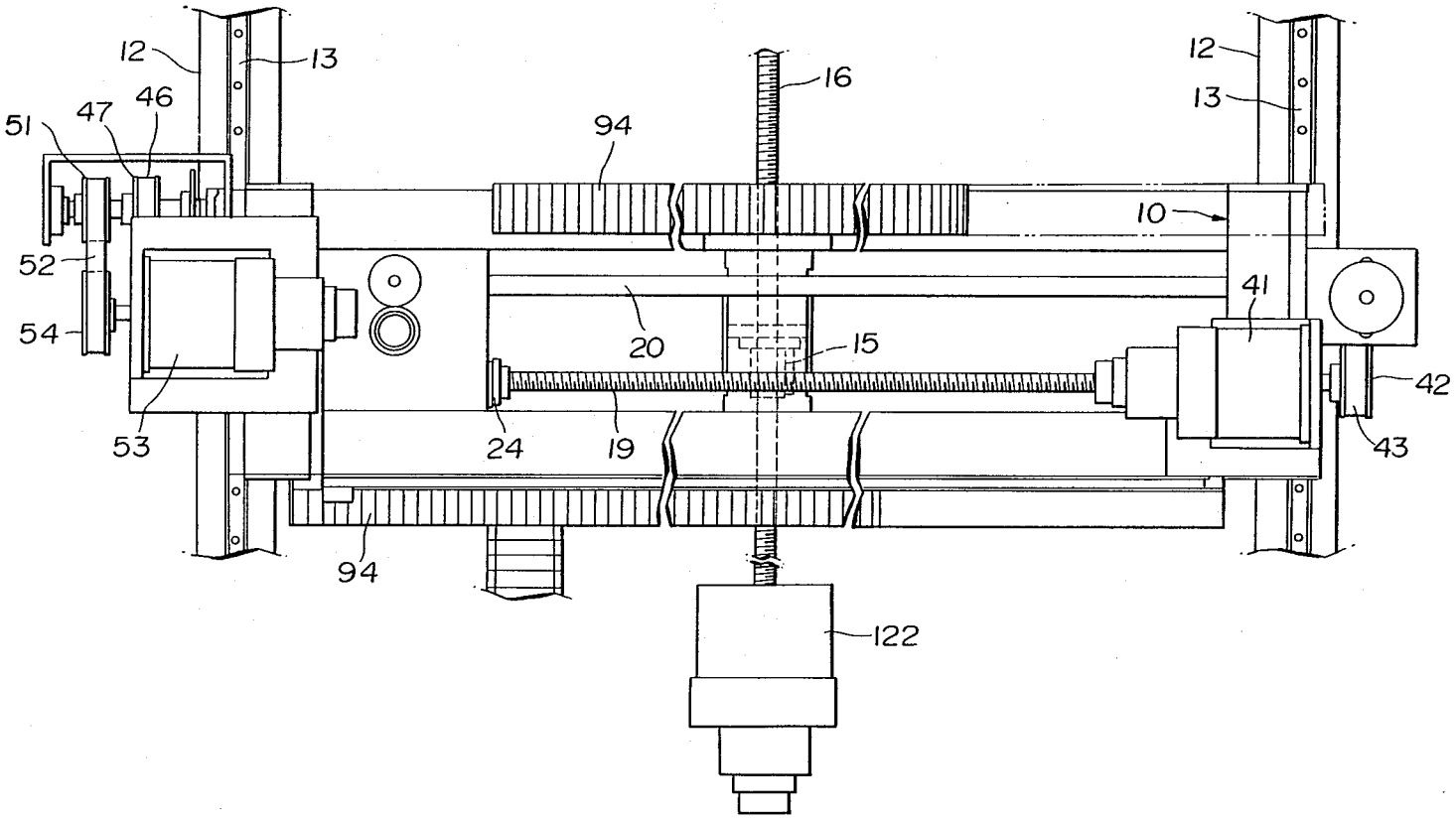
FIG. 2 is a plan view of the sewing machine in FIG. 1.

An embodiment of the present invention is illustrated in FIGS. 1 to 8 in which reference numeral 12 designates a foundation structure on which a pair of spaced parallel Y-axis guide rails 13 and 13 are disposed. A machine frame 10 is placed on the Y-axis guide rails 13 and 13. The machine frame 10 consists of a pair of pillar members 11 and 11, an upper horizontal member 17 extending between the top ends of the pillar members 11 and 11, and a lower horizontal member 21 extending between the bottom ends of the pillar members 11 and 11. The bottom end of each pillar member 11 is provided with two shoes 14 and 14 which are loosely engaged with the corresponding Y-axis guide rail 13. Consequently, the machine frame 10 is movable along the Y-axis guide rails 13 and 13. The lower horizontal member 21 is provided at its lower face's intermediate portion with a nut 15 which is threadedly engaged with a Y-axis lead screw 16 disposed parallel to the Y-axis guide rails 13. The opposite ends of the lead screw 16 is supported by the foundation structure 12 so that the lead screw 16 is rotatable about its axis. A machine frame-driving motor 122 is fixed to the foundation structure 12 and is drivingly connected to the lead screw 16. More specifically, a machine frame drive mechanism is constituted by the frame-driving motor 122, the lead screw 16 and the nut 15. Accordingly, when the lead screw 16 is rotated by the motor 122, the machine frame 10 is moved forward and backward along the Y-axis guide rails 13 and 13.

The upper horizontal member 17 is provided with: a pair of upper X-axis guide rails 18 and 18 (only one guide rail 18 being shown in FIG. 1); an upper lead screw 19 (see FIG. 2); and an upper spline shaft 20, which are disposed along the upper horizontal member 17 so that they are parallel to one another. The lower horizontal member 21 is provided with similar members to those of the upper horizontal member 17, that is, a pair of lower X-axis guide rails 22 and 22 (see FIG. 6), a lower lead screw 23 and a lower spline shaft 24, which are disposed along the lower horizontal member 21 so that they are parallel to one another. An upper support base 27 is loosely engaged at its shoes 30 and 30 with the upper X-axis guide rails 18 and 18 for horizontal movement along the guide rails 18 and 18. This upper support base 27 has an upper traveling nut 25 (see FIG. 5) and a hollow vertical cylindrical upper rotary member 26. The upper travel nut 25 is fixed to the upper support base 27 and is threadedly engaged with the upper lead screw 19. While on the other hand, the upper rotary member 26 is connected to the upper support base 27 via a bearing 112 for rotation about its axis and has an upper worm gear 29 coaxially fitting around the rotary member 26. This worm gear 29 is meshed with an upper worm 28 splined to the upper spline shaft 20. A lower support base 33 is loosely engaged at its shoe 33 with the lower X-axis guide rails 22 and 22 of the lower horizontal member 21 for horizontal movement along the guide rails 22. This lower support base 33 has a lower traveling nut 31 (see FIG. 6) and a hollow vertical cylindrical lower rotary member 32. The lower traveling nut 31 is fixed to the lower support base 33 and is meshed with the lower lead screw 23. On the other hand, the lower rotary member 32 is connected to the lower support base 33 for rotation about its axis and has a lower worm gear 35 coaxially fitting around the rotary member 32. This worm gear 35 is meshed with a lower worm 34 splined to the lower spline shaft 24.

As shown in FIG. 1, synchronous pulleys 37 and 38 fit fixedly and respectively around the left ends of the upper and lower lead screws 19 and 23. A connecting belt (lead screws-interlocking means) 39 is routed about the synchronous pulleys 37 and 38. Another synchronous pulley 40 fits fixedly around the right end of the upper lead screw 19. A support bases-driving motor 41 is secured to the right end of the upper horizontal member 17. This motor 41 has a driving pulley 42 fitting fixedly around the output shaft thereof, and another connecting belt 43 is routed about the pulleys 40 and 42. More specifically, when the support base-driving motor 41 is actuated, the upper and lower lead screws are rotated synchronously with each other, and thereby the upper and lower support bases 27 and 33 are simultaneously moved at the same distance and in the same direction. In addition, reference numeral 94 in FIG. 1 designates a cable bearer, and reference numeral 95 in FIG. 3 designates a guide pulley for the connecting belt 39.

Figure 3:
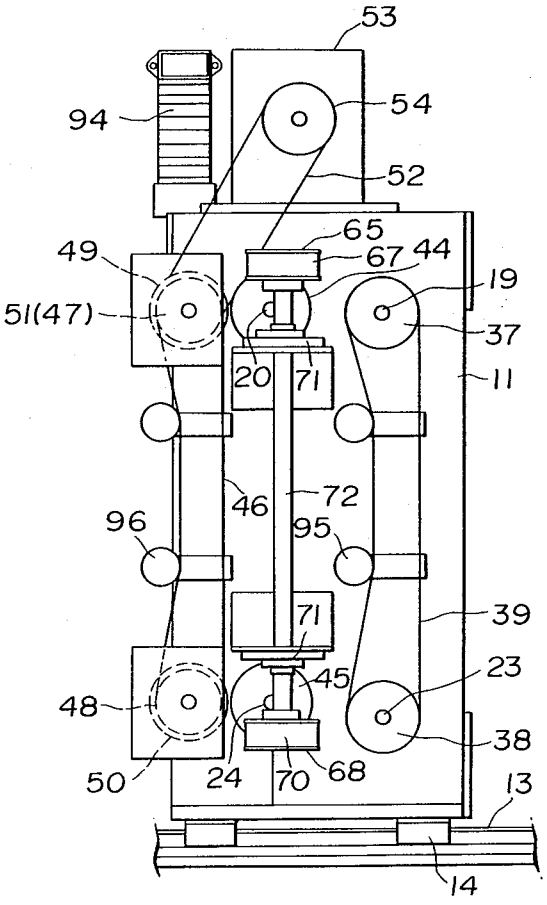
FIG. 3 is a side-elevational view of the sewing machine in FIG. 1.

As illustrated in FIG. 3, gears 44 and 45 are secured to the end of the upper and lower spline shafts 20 and 24 respectively. The gear 44 is meshed with a synchronous gear 49 which is supported by the pillar member 11 of the machine frame 10 for rotational movement thereof. While, the gear 45 is meshed with another synchronous gear 50 supported below the synchronous gear 49 in the same manner as the gear 49. Beside the synchronous gear 49, there is provided a synchronous pulley 47 (see FIG. 1) which rotates together with the gear 49 upon the rotation of the gear 49. Also, a synchronous pulley 48 is disposed beside the synchronous gear 50 in such a manner that it rotates together with the gear 50 upon the rotation of the gear 50. A connecting belt 46 is routed about the pulleys 47 and 48. In other words, spline shafts-interlocking means are constituted by the gears 44 and 45, the synchronous gears 49 and 50, synchronous pulleys 47 and 48 and connecting belt 46. Beside the synchronous pulley 47, there is provided another synchronous pulley 51 which rotates together with the pulley 47 upon the rotation of the pulley 47. This pulley 51 (which is disposed in front of the pulley 47 in FIG. 3) is connected to a drive pulley 54 of the rotary member-driving motor 53 via a connecting belt 52. This drive motor 53 is secured to the left end, as viewed in FIG. 1, of the upper horizontal member 17. Accordingly, when the motor 53 is operated, both the spline shafts 20 and 24 are rotated synchronously with each other in the same direction. In addition, reference numeral 96 in FIG. 3 denotes a guide pulley for the connecting belt 46.

A machine body 55 will hereunder be described.

Figure 5:
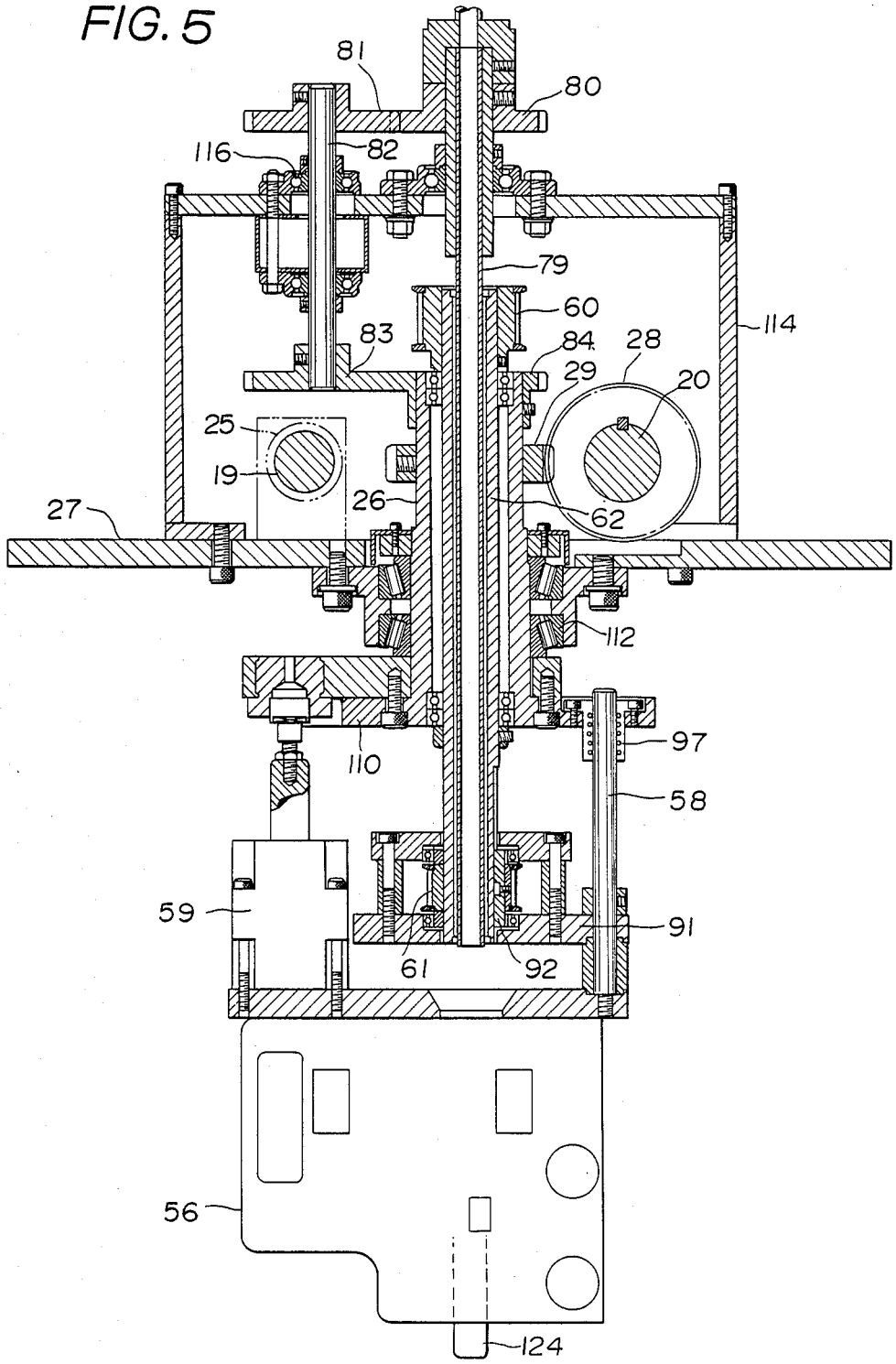
Figure 6:
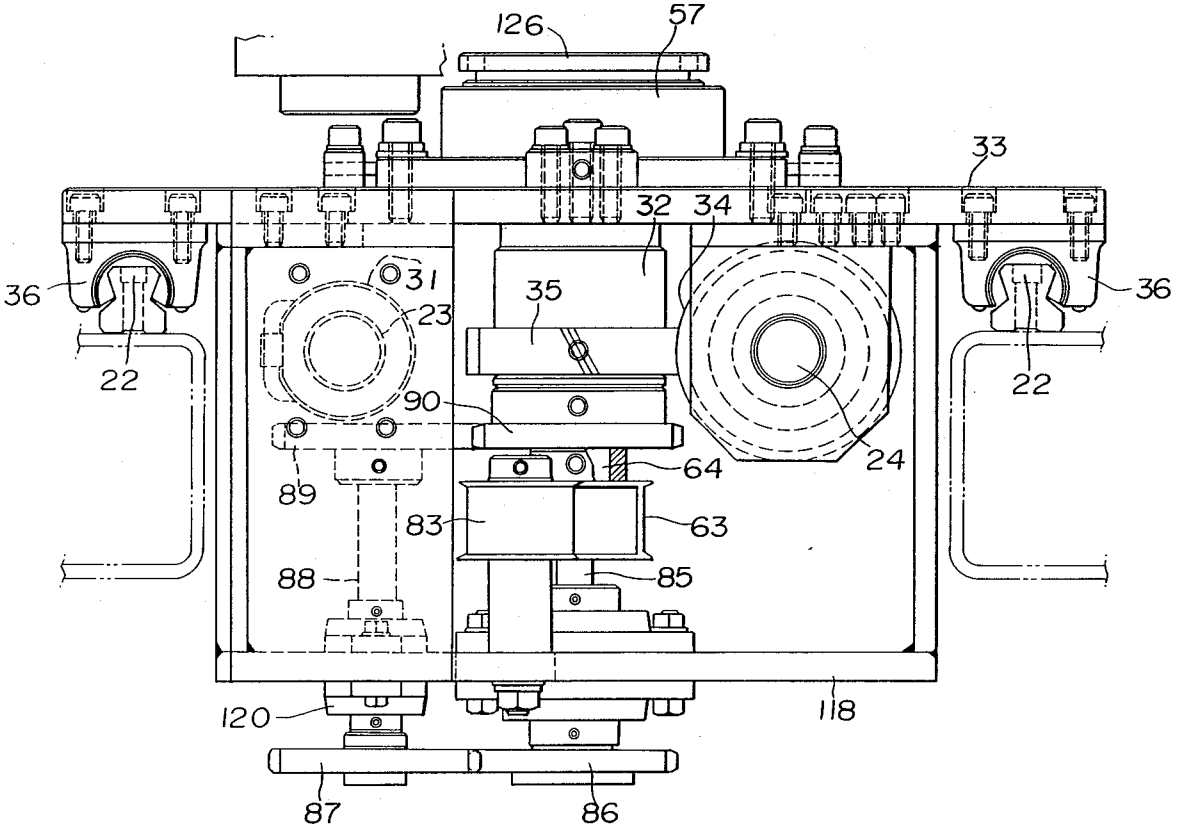
FIG. 6 is a side-elevational view of a bed unit in FIG. 1.

This machine body 55 includes: an arm unit 56 (see FIG. 1) having a needle bar 124 for holding a needle 98; and a bed unit 57 having a rotating hook 126. As shown in FIG. 5, the arm unit 56 is connected via four support rods 58 (only one rod being shown in FIG. 5) to the lower end of the upper rotary member 26 for upward and downward movement. The lower end of each support rod 58 is secured to the arm unit 56, while the upper end of each support rod 58 is fitted in the ball bearing 97 mounted on the flange portion 110 at the lower end of the upper rotary member 26. An air cylinder (vertical drive means) 59 is interposed between the flange portion 110 of the rotary member 26 and the arm unit 56. The upper end of this air cylinder 59 is secured to the upper rotary member 26, and the lower end of the air cylinder 59 is secured to the arm unit 56. Therefore, when the cylinder 59 is actuated, the arm unit 56 is moved upward and downward. As shown in FIG. 6, the bed unit 57 is secured to the upper end of the lower rotary member 32.

Figure 8:
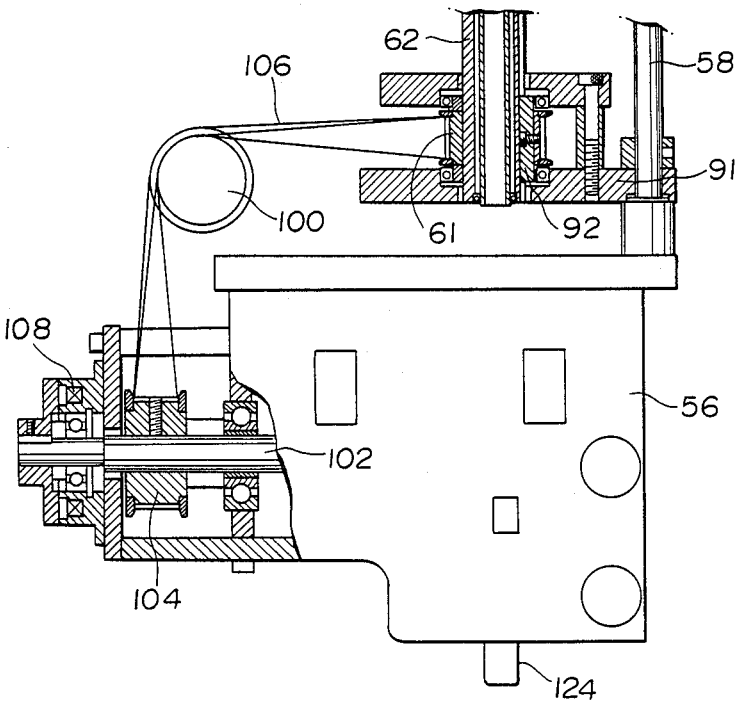
FIG. 8 is a side-elevational view partly in section of an arm unit in FIG. 5.

Returning to FIG. 5, a transmitting shaft 62 is inserted in the upper rotary member 26. A transmitting pulley is coaxially fixed to the upper end portion of the transmitting shaft 62, which projects from the top end of the upper rotary member 26. A sliding pulley 61 is coaxially splined to the lower end portion of the transmitting shaft 62 for upward and downward movement, the lower end portion being protruding from the bottom end of the upper rotary member 26. The sliding pulley 61 is connected to a pulley holder 91 for rotation about its axis. The pulley holder 91 is secured to the arm unit 56. That is, when the arm unit 56 is moved vertically, the sliding pulley 61 moves upward and downward with respect to the transmitting shaft 62. As shown in FIG. 8, the sliding pulley 61 is connected via a endless belt 106 to the driven pulley 104 which is secured to a needle bar-driving shaft 102 of the arm unit 56. The endless belt 106 passes through the space between the support rods 58 and is routed about a tension pulley 100 which is rotatably connected to the arm unit 56, and thus connecting the pulleys 61 and 104 to each other. Additionally, reference numeral 108 in FIG. 8 denotes an electromagnetic brake for braking the needle bar-driving shaft 102.

Referring to FIG. 6, a lower transmitting shaft 64 is inserted into the lower rotary member 32 for rotation about its axis. A transmitting pulley 63 is coaxially secured to the lower end portion of the lower transmitting shaft 64, which projects from the bottom end of the lower rotary member 32. The upper end portion of the lower transmitting shaft 64 is connected directly or via suitable transmitting means to the bed unit 57. For instance, the suitable transmitting means is a mechanism including, a transmitting pulley secured to the upper end of the lower transmitting shaft 64 and a connecting belt drivingly connecting this pulley with the rotating hook-driving shaft of the bed unit 57.

Figure 4:
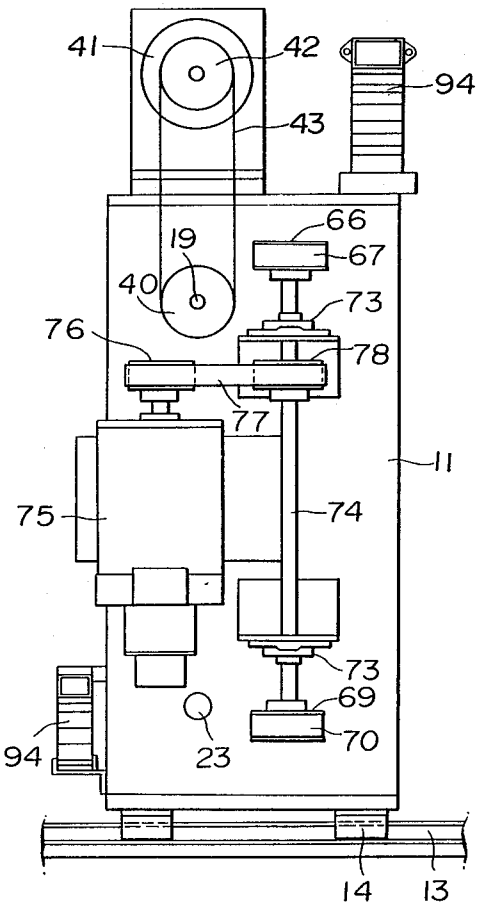
FIG. 4 is the other side-elevational view of the sewing machine in FIG. 1.
Figure 7:
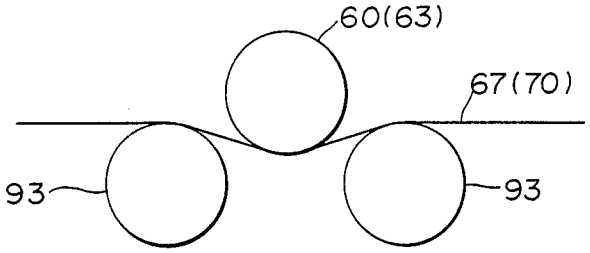
FIG. 7 is a schematic plan view of a pulley and a belt, showing the arrangement thereof, the pulley being provided on the transmitting shaft in FIGS. 5 and 6, the belt being used for transmitting the torque to the pulley.

The upper and lower transmitting shafts 62 and 64 are rotated synchronously with each other by the machine-driving motor 75 shown in FIGS. 1 and 4, and thereby transmit torque respectively to the needle bar-driving shaft 102 of the arm unit 56 and the rotating hook-driving shaft of the bed unit 57. More specifically, the motor 75 is secured to the right pillar member 11 as viewed in FIG. 1, and has an output shaft with a drive pulley 76. This drive pulley 76, as shown in FIG. 4, is connected to a transmitting pulley 78 via a connecting belt 77. This transmitting pulley 78 is secured to a vertical rotation shaft 74 which is connected via bearings 73 and 73 to the right pillar member 11 for rotation about its axis. Two other pulleys 66 and 69 are secured to the opposite ends of the rotation shaft 74. On the other hand, another vertical rotation shaft 72, as shown in FIG. 3, is connected via bearings 71 and 71 to the left pillar member 11 for rotational movement about its axis. Two still other pulleys 65 and 68 are secured to the opposite ends of the rotation shaft 72. The pulleys 65 and 66 are connected with each other by an upper transmitting belt 67, while the pulleys 68 and 69 are connected with each other by a lower transmitting belt 70. The upper and lower horizontal members 17 and 21 are of hollow constructions, and the upper and lower transmitting belts 67 and 70 are received in the upper and lower horizontal members 17 and 21 respectively. As shown in FIG. 7, at the substantially intermediate position between the pulleys 65 and 66, the upper transmitting belt 67 is routed about the pulley 60 of the upper transmitting shaft 62. Also, at the substantially intermediate position between the pulleys 68 and 69, the lower transmitting belt 70 is routed about the pulley 63 of the lower transmitting shaft 64. Additionally, reference numerals 93 and 93 in FIG. 7 designate guide pulleys disposed at opposite sides of each of the pulleys 60 and 63 in order to increase the contact areas of the pulleys 60 and 63 contacting respectively to the transmitting belts 67 and 70. Consequently, when the machine-driving motor 75 is operated, the torque of the motor 75 is transmitted to the rotation shaft 74 via the drive pulley 76, the connecting belt 77 and the transmitting pulley 78, resulting in synchronous movement of the upper and lower transmitting belts 67 and 70 in the same direction.

Returning again to FIG. 5, the upper transmitting shaft 62 is of a hollow cylindrical construction, and a wire conduit 79 for containing lead wires is inserted in the upper transmitting shaft 62 for rotation about its axis. A gear 80 is coaxially secured to the upper end portion of the wire conduit 79 which projects from the top end of the upper transmitting shaft 62. Another gear 81 is meshed with the gear 80. The gear 81 is secured to the top end of a vertical rotation shaft 82 rotatably supported by the housing 114 of the upper support base 27 via a bearing 116. Sill another gear 83 is secured to the bottom end of the rotation shaft 82, and this gear 83 is meshed with a further gear 84 coaxially secured to the top end of the upper rotary member 26. Accordingly, when the upper rotary member 26 is turned, the wire conduit 79 turns in the same direction and at the same angle about its axis as the rotary member 26, and thereby the lead wires in the conduit 79 are prevented from twisting. In the same manner as the conduit 79, another wire conduit 85 is inserted into the lower transmitting shaft 64 for rotational movement about its axis. As shown in FIG. 6, a gear 86 is coaxially secured to the lower end portion of the wire conduit 85 which protrudes from the bottom end of the lower transmitting shaft 64. Another gear 87 is meshed with the gear 86. This gear 87 is coaxially secured to the bottom end of a vertical rotation shaft 88 which is rotatably supported by the housing 118 of the lower support base 33 via a bearing 120. Still another gear 89 is coaxially secured to the top end of the rotation shaft 88, and this gear 89 is meshed with a further gear 90 coaxially secured to the bottom end of the lower rotary member 32. Consequently, the wire conduit 85 turns in the same direction and at the same angle about its axis as the lower rotary member 32 upon the rotation of the rotary member 32, and thereby the lead wires in the conduit 85 are prevented from twisting.

The operation of the sewing machine thus constructed will now be described.

First, the air cylinder 59 is actuated to lift the arm unit 56, enlarging the distance between the arm unit 56 and the bed unit 57. An article to be sewn such as a thick bed quilt and the like is inserted between the arm and bed units 56 and 57, and placed on a suitable, conventional bed member for supporting articles to be sewn. For example, the suitable bed member has a plurality of clips for clamping the edges of the bed quilt to set it between the arm and bed unit 56 and 57, and also has legs secured onto the floor or legs with casters for enabling the bed member to move relative to the floor. After setting the bed quilt at the proper position, the air cylinder 59 is again actuated to move the arm unit 56 this time downward to the predetermined level. As the arm unit 56 is vertically moved, the sliding pulley 61 of the upper transmitting shaft 62 moves upward and downward together with the pulley holder 91. When it is required to sew the bed quilt in a direction parallel to the Y-axis guide rails 13 with straight stitches, the machine-driving motor 75 is actuated to synchronously operate the arm and bed units 56 and 57, and, at the same time, the machine frame-driving motor 122 is actuated to rotate the Y-axis lead screw 16, moving the arm and bed units 56 and 57 together with the machine frame 10 forward and backward along the Y-axis guide rails 13.

When straight stitches along a direction parallel to the X-axis guide rails are required, the arm and bed units are operated by the motor 75 in the same manner as is mentioned above, and, simultaneously, the upper and lower lead screws are rotated to synchronously move the arm and bed units 56 and 57 transversely along the X-axis guide rails 18 and 22.

When a diagonal straight sewing is required, the arm and bed units 56 and 57 are synchronously operated, and, at the same time, both the machine frame-driving motor 122 and the support bases-driving motor 41 are simultaneously actuated. When a circular sewing is required, the revolutions of both the machine frame-driving motor 122 and the support bases-driving motor 41 are gradually varied depending on the radius of the circle to be formed.

When zigzag stitches are required, the arm and bed units 56 and 57 are operated, and, simultaneously, the machine frame 10 is moved either forward or backward and the arm and bed units 56 and 57 are moved right and left alternately. During this zigzag stitch sewing, since it is necessary to orient the arm and bed units in their sewing direction, the rotary member-driving motor 53 is actuated to turn the rotary members 26 and 32.

Upon the termination of the sewing operation, all the drive motors are stopped, and the air cylinder 59 is again operated to lift the arm unit 56. After that, the resultant sewn bed quilt is taken out of the position between the arm and bed units 56 and 57.

Although in the foregoing embodiment, the four support rods 54 are employed to assure the accurate vertical movement of the arm unit 56, the number of the rod 56 may be less than 4 or more than 4. In place of the air cylinder 59, other suitable means such as an electromagnet, a pinion and rack mechanism, a screw and nut mechanism and the like may be employed. It is preferred that timing belts are used as the belts 39, 43, 46, 52, 67 and 70. It is also preferred that timing pulleys are used as the pulleys cooperating with the timing belts. Furthermore, it is preferred that ball screws are used as the lead screws 16, 19 and 23, and that ball spline shafts are used as the spline shafts 20 and 24.

INDUSTRIAL APPLICABILITY

The sewing machine according to the present invention is useful as a sewing machine for industrial use, in sewing articles such as clothes, bedclothes and the like, and, in particular, is suitable for efficiently sewing thick bed quilts.

What is claimed is:

1. A sewing machine comprising:

a machine frame having upper and lower spaced parallel X-axis guide members extending substantially horizontally;

upper and lower support bases connected respectively to the upper and lower guide members for movement respectively along the upper and lower guide members;

support bases drive means for synchronously moving the upper and lower support bases respectively along the upper and lower guide members;

upper and lower rotary members rotatably connected respectively to the upper and lower support bases for turning movement about vertical axes;

turning means for turning the upper and lower rotary members synchronously with each other;

a machine body having an arm unit and a bed unit, the arm unit being connected to the upper rotary member and having a needle bar, the bed unit being secured to the lower rotary member so as to confront the arm unit and having a rotating hook;

machine body drive means for operating the arm and bed units synchronously with each other;

mounting means interconnecting the arm unit with the upper rotary member for upward and downward movement of the arm unit; and vertical drive means for vertically moving the arm unit so that the distance between the arm unit and the bed unit is adjusted, wherein said upper rotary member is of a vertical tubular construction and said machine body drive means comprises:

upper and lower vertical transmitting shafts, the upper transmitting shaft being inserted into the upper rotary member for rotation about an axis thereof, the lower transmitting shaft being inserted into the lower rotary member for rotation about an axis thereof, the lower transmitting shaft being drivingly connected to the bed unit so as to transmit the torque thereof to the rotating hook;

a single machine actuator, drivingly connected to the upper and lower transmitting shafts, for rotating both the upper and lower transmitting shafts; and a sliding pulley coaxially splined to the upper transmitting shaft for sliding movement along the upper transmitting shaft and drivingly connected to the arm unit so as to transmit the torque of the upper transmitting shaft to the needle bar and wherein said arm unit comprises a pulley holder holding the sliding pulley in such a manner that the sliding pulley is rotatable relative to the holder, whereby, when the arm unit is vertically moved, the sliding pulley is also vertically moved together with the arm unit.

2. A sewing machine as recited in claim 1, wherein the upper rotary member has a flange portion formed therearound, and wherein the mounting means comprises a support rod having upper and lower end portions, the upper end portion being connected to the flange portion for vertical movement, the lower end portion secured to the arm unit.

3. A sewing machine as recited in claim 2, wherein the vertical drive means comprises a cylinder actuator interposed between the upper rotary member and the arm unit.

4. A sewing machine as recited in claim 3, further comprising: a wire conduit for containing lead wires therewithin, the wire conduit axially passing through the transmitting shaft for turning movement about an axis thereof; and means for turning the wire conduit in the same direction and at the same angle about the axis thereof as the upper rotary member upon the turning movement of the upper rotary member so as to prevent the lead wires in the conduit from twisting.

5. A sewing machine as recited in claim 4, further comprising: a Y-axis guide member extending horizontally and perpendicularly to the X-axis guide members; and machine frame drive means for driving the machine frame along the Y-axis guide member.

6. A sewing machine as recited in claim 5, wherein the support bases drive means comprises: upper and lower traveling nuts secured to the upper and lower support bases respectively; upper and lower lead screws threadedly engaged with the upper and lower traveling nuts and extending along the upper and lower X-axis guide members respectively, the upper and lower lead screws being connected to the machine frame for rotation about their respective axes; lead screws-interlocking means for connecting the upper and lower lead screws so that the lead screws are rotated synchronously with each other; and a support bases-driving actuator drivingly connected to either of the upper and lower lead screws.

7. A sewing machine as recited in claim 5, wherein the turning means comprises: upper and lower worm gears coaxially secured to the upper and lower rotary members respectively; upper and lower worms meshed with the upper and lower worm gears respectively; upper and lower spline shafts splined to the upper and lower worms respectively and extending respectively along the upper and lower X-axis guide members, the upper and lower spline shafts connected to the machine frame for rotational movement about their respective axes; spline shafts-interlocking means for connecting the upper and lower spline shafts so that the spline shafts are turned synchronously with each other; and a rotary members-driving actuator for turning both the spline shafts under the control of the spline shafts-interlocking means.

8. A sewing machine as recited in claim 3, wherein the machine actuator is mounted on the machine frame, and wherein the machine actuator is drivingly connected to the upper and lower transmitting shafts by means of belt-and-pulley mechanism.

* * * * *